US012188256B1

(12) United States Patent
Xiang et al.

(10) Patent No.: US 12,188,256 B1
(45) Date of Patent: Jan. 7, 2025

(54) CONFIGURATION AND CLOSE-FITTING JOINT FOR SECOND-ORDER SCISSOR DAMPER AND ASSEMBLY METHOD FOR THE SAME

(71) Applicant: Tongji University, Shanghai (CN)

(72) Inventors: Yang Xiang, Shanghai (CN); Lisha Liao, Shanghai (CN); Guo-Qiang Li, Shanghai (CN); Kui-Yuan Xu, Shanghai (CN); Yi-Qiong Cui, Shanghai (CN)

(73) Assignee: Tongji University, Shanghai (CN)

( * ) Notice: Subject to any disclaimer, the term of this patent is extended or adjusted under 35 U.S.C. 154(b) by 0 days.

(21) Appl. No.: 18/613,175

(22) Filed: Mar. 22, 2024

(51) Int. Cl.
*E04H 9/02* (2006.01)
*E04B 1/98* (2006.01)

(52) U.S. Cl.
CPC ..... *E04H 9/0237* (2020.05); *E04B 1/98* (2013.01)

(58) Field of Classification Search
CPC ..... E04B 1/98; E04H 9/0237
USPC ..... 52/167.3, 167.4
See application file for complete search history.

(56) References Cited

U.S. PATENT DOCUMENTS 4,480,731 A * 11/1984 Izeki ..... E04B 1/98 188/290
4,504,708 A * 3/1985 Hartig ..... H01H 31/36 200/337
4,531,334 A * 7/1985 Nylander ..... E04B 1/98 52/109
5,934,028 A * 8/1999 Taylor ..... E04H 9/0235 403/171
6,397,528 B1 * 6/2002 Rahimian ..... E04H 9/0237 52/167.3
6,837,010 B2 * 1/2005 Powell ..... E04H 9/0237 403/174
7,703,244 B2 * 4/2010 Suzuki ..... E04B 1/24 403/217
8,136,309 B2 * 3/2012 Rahimian ..... E04H 9/0235 188/380
9,567,763 B2 * 2/2017 Miyazawa ..... E04H 9/024
10,106,979 B2 * 10/2018 Lee ..... E04B 1/98
2001/0045069 A1 * 11/2001 Constantinou ..... E04H 9/0235 52/167.3
2002/0129568 A1 * 9/2002 Oka ..... E04H 9/0237 52/167.3
2004/0107654 A1 * 6/2004 Powell ..... E04H 9/0237 52/167.3

(Continued)

*Primary Examiner* — Paola Agudelo
(74) *Attorney, Agent, or Firm* — IDEA Intellectual Limited; Margaret A. Burke; Sam T. Yip

(57) ABSTRACT

The present invention relates to the technical field of construction engineering, and specifically to configurations and close-fitting joints for a second-order scissor damper and an assembly method for the same. There six parts in total, including first hinge joints, a first-order shuttle-shaped linkage mechanical component, second hinge joints, a second-order shuttle-shaped linkage mechanical component, third hinge joints, and a viscous damper; the second-order shuttle-shaped linkage mechanical component includes four small connecting rods of equal length and it is formed by hinging them together. The device of the present invention can constrain the joints, release the bending constraints on the ends of the rods, and enable a significant increase in the stroke amplification of the conventional scissor damper.

8 Claims, 6 Drawing Sheets

(56) References Cited

U.S. PATENT DOCUMENTS

| | | | | |
|---|---|---|---|---|
| 2010/0313496 | A1* | 12/2010 | Rahimian | E04H 9/0237 52/167.3 |
| 2012/0121413 | A1* | 5/2012 | Rodriguez | F03D 7/02 416/31 |
| 2016/0244966 | A1* | 8/2016 | Miyazawa | E04H 9/0237 |
| 2019/0040645 | A1* | 2/2019 | Zhao | E04B 1/2403 |
| 2021/0088102 | A1* | 3/2021 | Guo | F16F 13/00 |
| 2023/0235556 | A1* | 7/2023 | Belen | F16B 2/065 52/167.3 |

* cited by examiner

CONFIGURATION AND CLOSE-FITTING JOINT FOR SECOND-ORDER SCISSOR DAMPER AND ASSEMBLY METHOD FOR THE SAME

TECHNICAL FIELD

The invention relates to the technical field of construction engineering, and specifically to configurations and close-fitting joints for a second-order scissor damper and an assembly method for the same.

BACKGROUND

Along with the increasingly prominent characteristics of modern architectural structures such as "tall, lightweight, and flexible," the demands for vibration control of building structures under dynamic loads such as wind loads, seismic actions, environmental/equipment excitations, and human-induced excitations have become more pronounced. For now, the scissor damper stroke amplification device is considered one of the most comprehensive and reliable approaches.

The scissor damper (energy dissipater) has a basic configuration of "4 rods plus 1 damper" arranged in a shuttle shape, which efficiently converts inter-story displacements of the building structure into axial strokes of the damper. However, the connections of the structure equipped with scissor damper (SDJ) and the connections between internal components of the scissor damper commonly use pin-type articulated connections, in which such connection type faces two major issues:

Firstly, the connection lacks strong constraint capability for the "relative linear displacement" of the connected components' ends. Specifically, due to the limitations in processing and installation precision, the currently used pin-type articulated joints in the field of building structures exhibit the feature of "pin diameter smaller than hole diameter of gusset plate". When there is a relative linear displacement trend between the ends of two or more components connected by a joint, the gap between the pin and the connecting plate will cause the joint to be unable to effectively constrain the relative linear displacement between the components. This causes a (large) part of the structural deformation to be eliminated between the joint pin and the hole wall, unable to be transmitted and converted into the deformation stroke of the energy dissipater. Macroscopically, this phenomenon manifests as insensitivity of the energy dissipater and its connecting components to small-scale vibrational deformations of the building structure, compromising the efficiency of vibration control.

Secondly, the joint is difficult to completely release its bending constraint on the ends of the components. Specifically, the contact between the pin and the gusset plate can lead to a nonzero starting torque between them, making it challenging to ensure the axial tension/compression state of the energy dissipater (resulting in a pull-bend/compression-bend state).

SUMMARY OF INVENTION

In view of the problems in the above-mentioned prior art that the scissor damper connection does not have the strong ability to constrain the "relative linear displacement" of the ends of the connected rods and that the joints are difficult to completely release their bending constraints on the ends of the rods, the present invention is provided accordingly.

Therefore, the object of the present invention is to provide a configuration and close-fitting joints for a second-order scissor damper.

To solve the above technical problems, the present invention provides the following technical solutions, including totally six parts with first hinge joints, a first-order shuttle-shaped linkage mechanical component, second hinge joints, a second-order shuttle-shaped linkage mechanical component, third hinge joints, and a viscous damper; the second-order shuttle-shaped linkage mechanical component includes four small connecting rods with equal length and it is formed by hinging them together.

As a preferred solution for the configuration and the close-fitting joints for the second-order scissor damper of the present invention, in which: the first hinge joint includes an end gusset plate group and two first rolling annular wedge close-fitting hinge joints; where, the end gusset plate group includes two gusset plates, a connecting plate with oblique cut holes, and several stiffening ribs which match a shape of sidewalls of the first rolling annular wedge close-fitting hinge joints; where the two gusset plates are orthogonally welded to form an L-shaped gusset plate group, the connecting plate with oblique cut holes is hinged with the first rolling annular wedge close-fitting hinge joints, the number of the stiffening ribs is four, the connecting plate with oblique cut holes is provided with large connecting rods, the four large connecting rods with equal length are combined into the first-order shuttle-shaped linkage mechanical component, and both ends of each of the four large connecting rods are connected to the first hinge joint and the second hinge joint, respectively.

As a preferred solution for the configuration and the close-fitting joints for the second-order scissor damper of the present invention, in which: the second hinge joint includes a first rolling annular wedge mating hinge joint and a second rolling annular wedge mating hinge joint. The first rolling annular wedge mating hinge joint is connected to the large connecting rods, and the second rolling annular wedge mating hinge joint (32) is connected to the small connecting rods.

As a preferred solution for the configuration and the close-fitting joints for the second-order scissor damper of the present invention, in which: each of the small connecting rods has both ends connected to the second hinge joint and the third hinge joint, respectively.

As a preferred solution for the configuration and the close-fitting joints for the second-order scissor damper of the present invention, in which: the third hinge joint includes two second rolling annular wedge mating hinge joints and an ear plate connected to the viscous damper.

As a preferred solution for the configuration and the close-fitting joints for the second-order scissor damper of the present invention, in which: the viscous damper has both ends connected to the third hinge joints, respectively.

As a preferred solution for the configuration and the close-fitting joints for the second-order scissor damper of the present invention, in which: each of the first hinge joints, the second hinge joints, and the third hinge joints is provided with the first rolling annular wedge close-fitting hinge joints thereon.

As a preferred solution for the configuration and the close-fitting joints for the second-order scissor damper of the present invention, in which the first rolling annular wedge close-fitting hinge joint includes: a pin shaft, a nut-washer combination component, a rolling annular wedge, an oblique-hole gusset plate, and a conversion transfer board.

As a preferred solution for the configuration and the close-fitting joints for the second-order scissor damper of the present invention, in which: the pin shaft is a steel cylinder with standard threads pre-cut at both ends thereof, and the pin shaft connects each of gusset plates linked by the first rolling annular wedge close-fitting hinge joints in series.

As a preferred solution for the configuration and the close-fitting joints for the second-order scissor damper of the present invention, in which: the nut-washer combination component includes: a nut, a large diameter washer, and a small diameter washer; where, the nut is a hexagonal nut with a standard hexagonal threaded hole in the center; where, one side of the large diameter washer abuts against a bottom surface of the nut; where, one side of the small diameter washer abuts against a guiding-groove annular wedge; where, on another side, the large diameter washer and the small diameter washer abut against each other; where, the large diameter washer and the small diameter washer are matched.

As a preferred solution for the configuration and the close-fitting joints for the second-order scissor damper of the present invention, in which: the rolling annular wedge includes the guiding-groove annular wedge, a retaining frame, and cylindrical rollers; where, the guiding-groove annular wedge has an annular guiding-groove for accommodating the retaining frame; where, the annular guiding-groove restricts irregular displacement of the cylindrical rollers; where, a cross-section of the guiding-groove annular wedge is in a slotted pedestal wedge shape, and the slotted pedestal wedge shape includes a wedge part and a pedestal part; where, the wedge part is in a shape of an elongated triangular pyramid, gradually becoming thicker from a head end to a tail end; where, the pedestal part is trapezoidal and smoothly transitions from a rear end of the wedge part; where, the cylindrical rollers include several identical steel cylindrical balls; where, the cylindrical rollers are set inside the retaining frame, and the several cylindrical rollers are evenly spaced by the retaining frame; where, the cylindrical rollers are able to rotate within the retaining frame; where, a combination of the cylindrical rollers and the retaining frame is embedded in the annular guiding-groove.

As a preferred solution for the configuration and the close-fitting joints for the second-order scissor damper of the present invention, in which: the oblique hole gusset plate includes a plate body and an oblique-section circle-hole; where, a middle part of the plate body is provided with a through hole; where, an inner wall of the oblique-section circle-hole is an inclined surface, which matches a shape of a sidewall of the guiding-groove annular wedge.

As a preferred solution for the configuration and the close-fitting joints for the second-order scissor damper of the present invention, in which: the conversion transfer plate is an ordinary steel structure joint plate, and the conversion transfer plate is connected to an oblique-section gusset plate.

The configuration and the close-fitting joints for the second-order scissor damper of the present invention have advantages as follows: by setting the first-order shuttle-shaped linkage mechanical component and the second-order shuttle-shaped linkage mechanical component, the "relative linear displacement" of the end of the connecting rod can be strongly constrained. And, by setting the first hinge joints, the second hinge joints, and the third hinge joints, it can release the bending constraints of joints, thereby solving the problem that the scissor damper connection does not have the strong constraint capability of the "relative linear displacement" of the ends of the connected rods and that the joints are difficult to completely release their bending constraints on the ends of the rods.

BRIEF DESCRIPTION OF DRAWINGS

To provide a clearer explanation of the technical solution of the embodiments of the present invention, a brief introduction to the drawings required in the description of the embodiments will be made below. It is clear that the drawings in the following description are only for some embodiments of the present invention; for those of ordinary skill in the art, other drawings can also be obtained based on these drawings without exerting creative efforts.

DETAILED DESCRIPTION OF THE INVENTION

In order to make the above objects, features and advantages of the present invention more obvious and easy to understand, the specific embodiments of the present invention will be described in detail below with reference to the accompanying drawings.

Many specific details are set forth in the following description to fully understand the present invention. However, the present invention can also be implemented in other ways different from those described herein. Those skilled in the art can do similar popularizing without departing from the connotation of the present invention, and therefore the present invention is not limited to the specific embodiments disclosed below.

Second, reference herein to "one embodiment" or "an embodiment" refers to a specific feature, structure, or characteristic that may be included in at least one implementation of the present invention. The appearances of "in one embodiment" in different places in this specification do not all refer to the same embodiment, nor are they separate or selectively mutually exclusive with other embodiments.

EMBODIMENT 1

Figure 1:
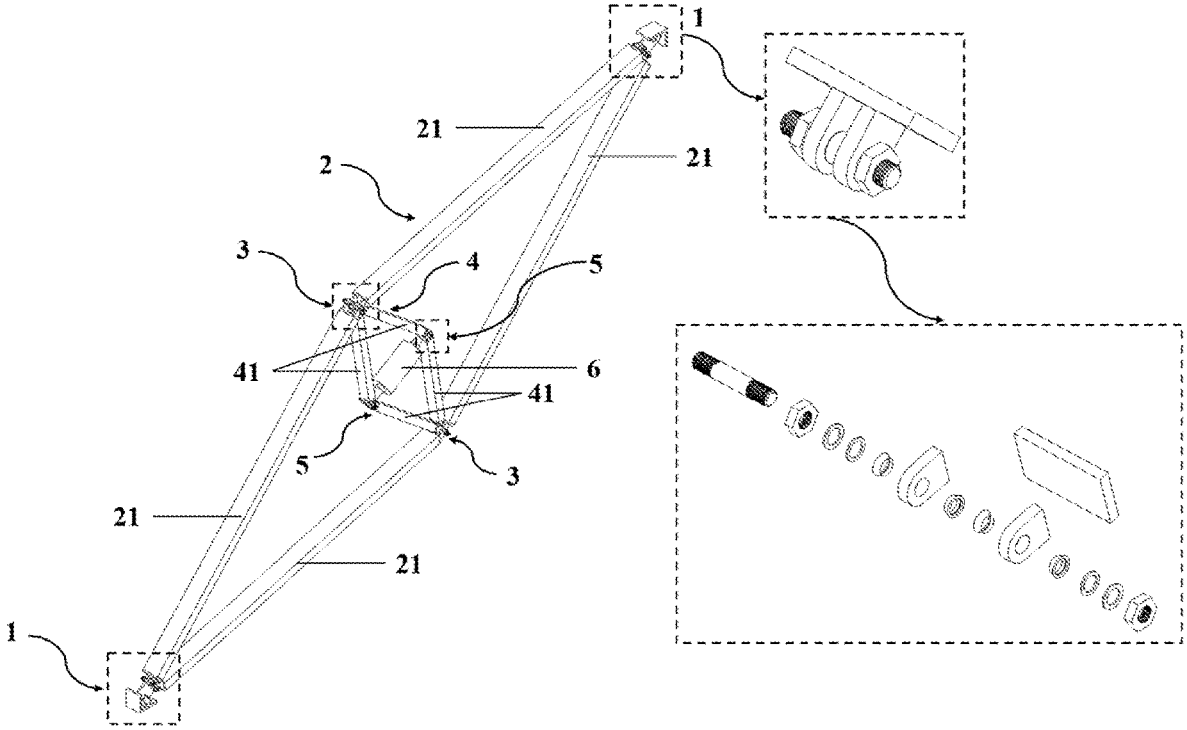
FIG. 1 is a schematic diagram of a second-order scissor damper according to the present invention.
Figure 2:
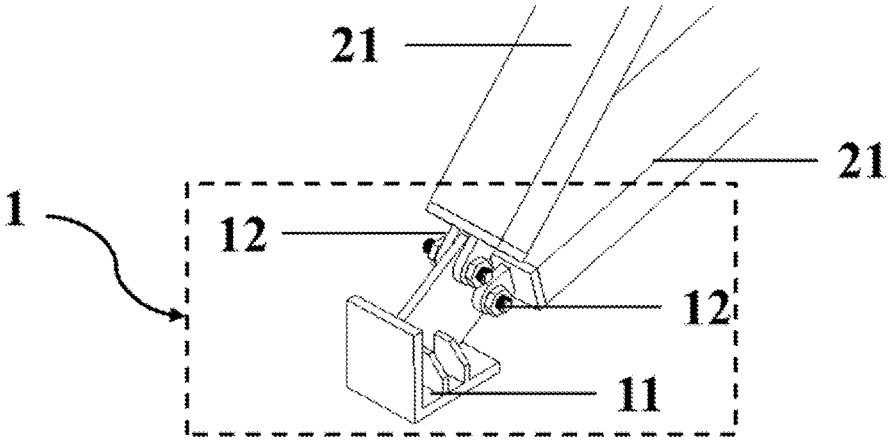
FIG. 2 is an enlarged schematic diagram of a first hinge joint of the present invention.
Figure 3:
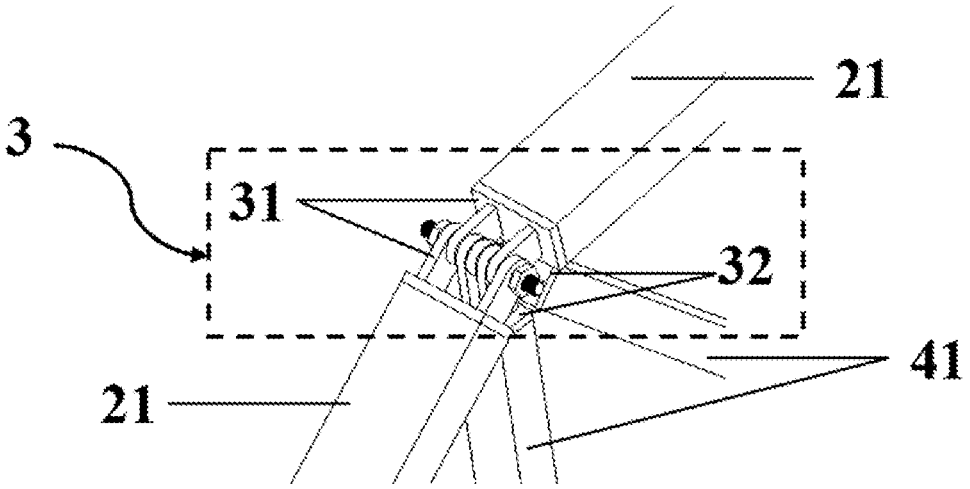
FIG. 3 is an enlarged schematic diagram of a second hinge joint of the present invention.
Figure 4:
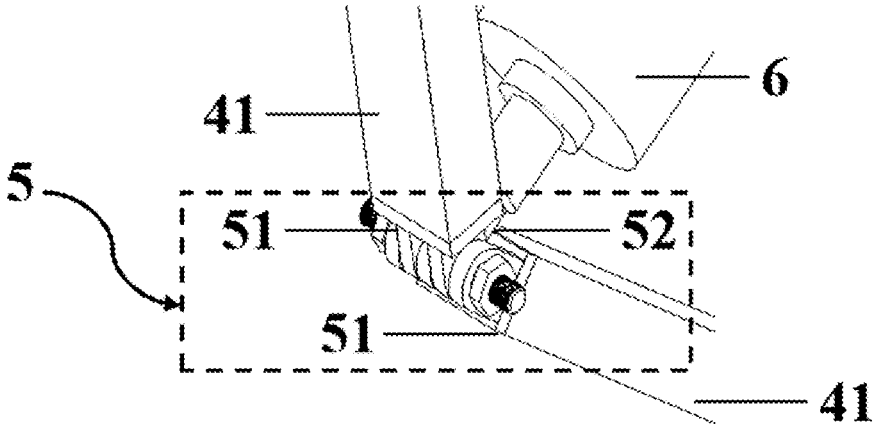
FIG. 4 is an enlarged schematic diagram of a third hinge joint of the present invention.
Figure 5:
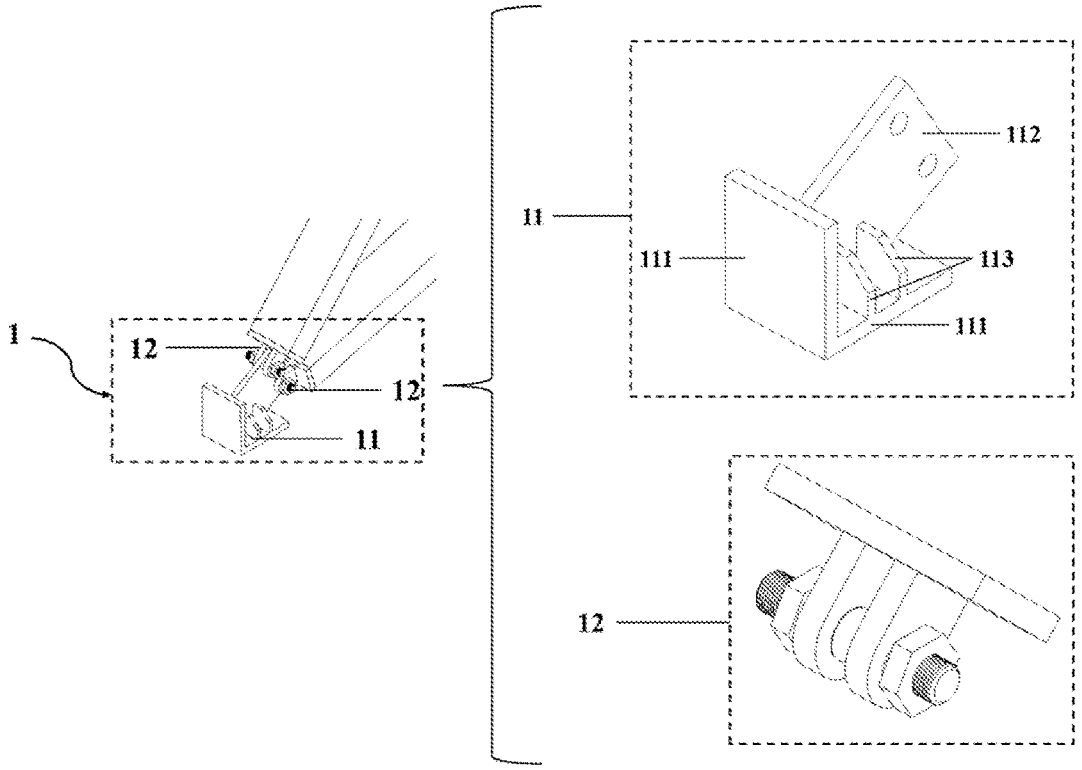
FIG. 5 is an exploded schematic diagram of components of the first hinge joint of the present invention.
Figure 6:
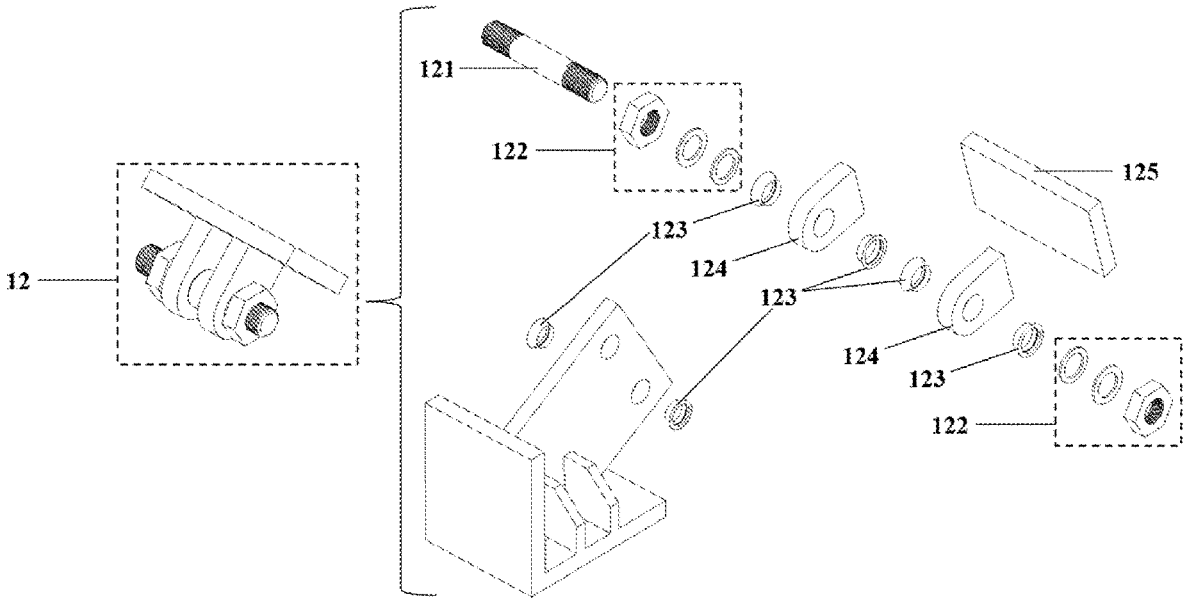
FIG. 6 is a schematic diagram of a rolling annular wedge-locked hinge joint of the present invention.
Figure 7:
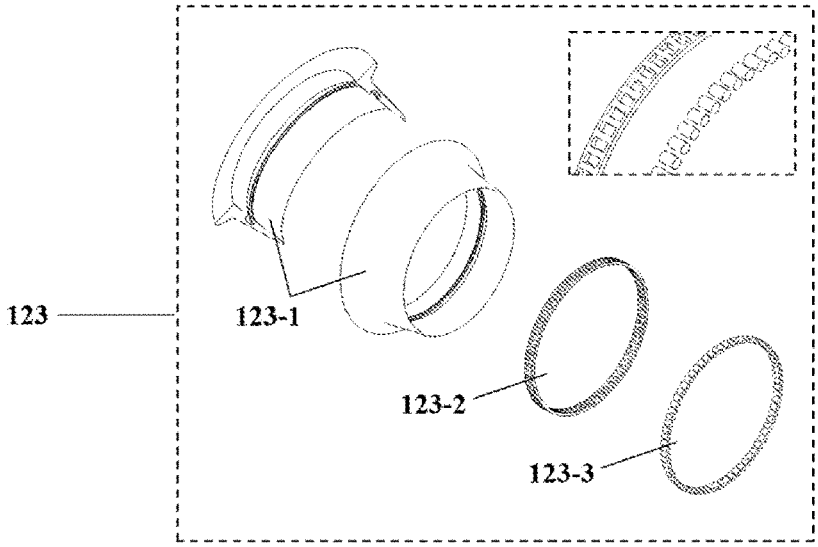
FIG. 7 is a schematic diagram of a rolling annular wedge according to an embodiment of the present invention.
Figure 8:
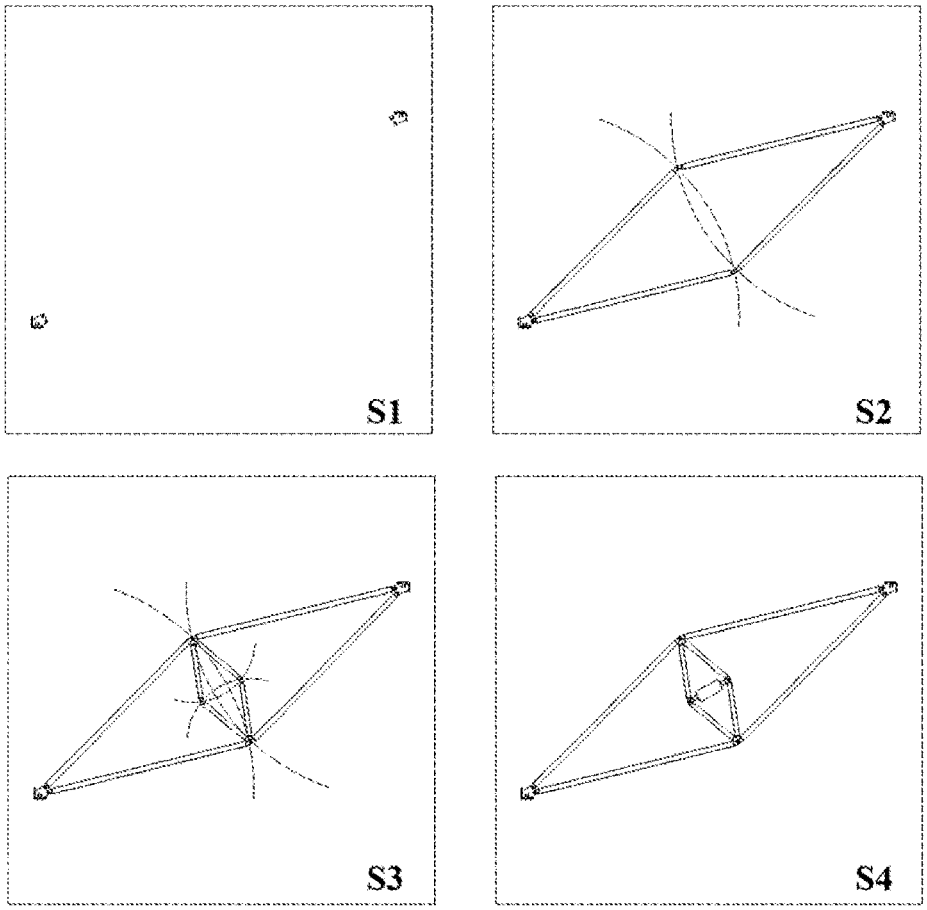
FIG. 8 is an assembly process diagram of the second-order scissor damper according to an embodiment of the present invention.
Figure 9:
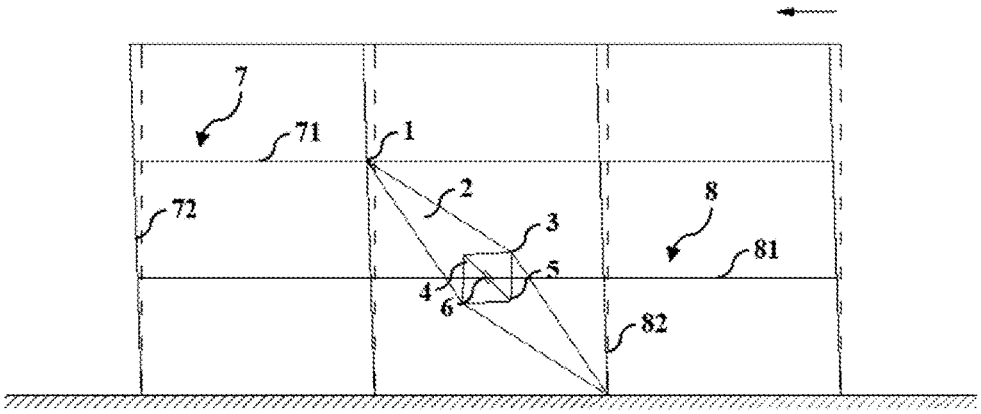
FIG. 9 is a schematic diagram of the using state of the second-order scissor damper for cross-layer dissipation connection in a structure according to an embodiment of the present invention.
Figure 10:
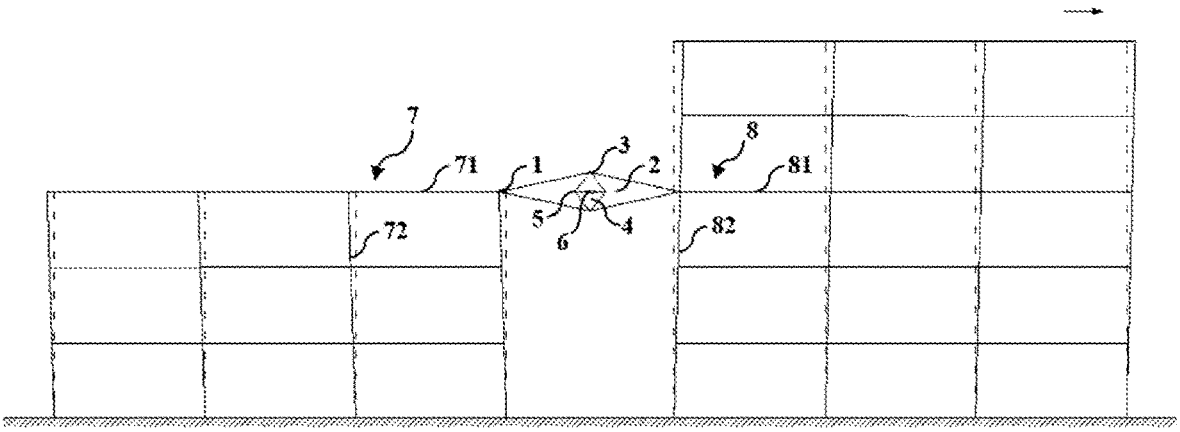
FIG. 10 is a schematic diagram of the using state of the second-order scissor damper for dissipation connection between adjacent building structures according to an embodiment of the present invention.
Figure 11:
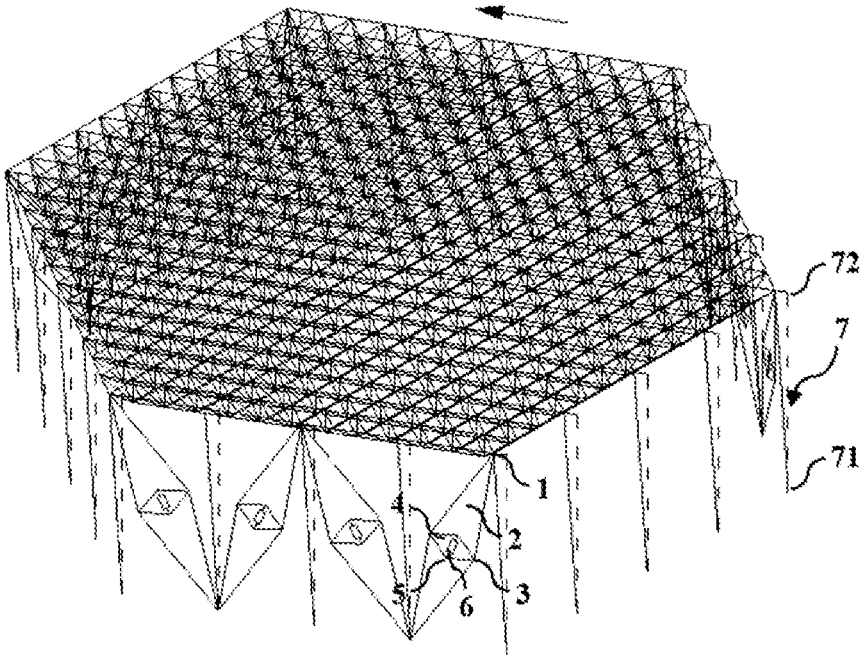
FIG. 11 is a schematic diagram of the using state of the second-order scissor damper for dissipation connection between a large roof and the ground according to an embodiment of the present invention.

Referring to FIG. 1 to FIG. 11, a first embodiment of the present invention is shown. This embodiment provides a configuration and close-fitting joints for a second-order scissor damper, including:

totally six parts, including first hinge joints 1, a first-order shuttle-shaped linkage mechanical component 2, second hinge joints 3, a second-order shuttle-shaped linkage mechanical component 4, third hinge joints 5, and a viscous damper 6;

where, the second-order shuttle-shaped linkage mechanical component 4 includes four small connecting rods 41 with equal length and it is formed by hinging them together;

where, the first hinge joint 1 includes an end gusset plate group 11 and two novel first rolling annular wedge close-fitting hinge joints 12; where, the end gusset plate group 11 includes two gusset plates 111, a connecting plate 112 with oblique cut holes, and several stiffening ribs 113. The connecting plate 112 with oblique cut holes have an inner wall in an oblique surface, which matches a shape of sidewalls of the first rolling annular wedge close-fitting hinge joints 12. The two gusset plates 111 are orthogonally welded to form an L-shaped gusset plate group, and the connecting plate 112 with the oblique cut holes is welded on the L-shaped gusset plate group, and then several stiffeners 113 are welded thereto; where, the L-shaped gusset plate group is used to connect various building structures, and the connecting plate 112 with oblique cut holes is hinged with the first rolling annular wedge close-fitting hinge joints 12; in the present invention, the number of the stiffening ribs 113 is four, which is used for strengthening the end gusset plate group 11, and the first-order shuttle-shaped linkage mechanical component 2 of the connecting plate 112 with oblique cut holes is provided with large connecting rods 21 with equal length. Both ends of each of the four large connecting rods 21 are connected to the first hinge joint 1 and the second hinge joint 3, respectively;

where, the second hinge joint 3 includes four novel rolling annular wedge mating hinge joints 31, 32, in which the novel rolling annular wedge mating hinge joint 31 (which is labeled as 31) is connected to the second-order shuttle-shaped linkage 21 and the novel rolling annular wedge mating hinge joint 32 (which is labeled as 32) is connected to the second-order shuttle-shaped linkage 41;

where, the second-order shuttle-shaped linkage mechanical component 4 is formed by hinging the four small connecting rods 41 with equal length, and both ends of each small connecting rod 41 are connected to the second hinge joint 3 and the third hinge joint 5, respectively;

where, the third hinge joint 5 includes two novel second rolling annular wedge mating hinge joints 51 and an car plate 52 connected to the viscous damper 6;

where, the viscous damper 6 has both ends connected to the third hinge joints 5, respectively;

where, the novel rolling annular wedge close-fitting hinge joints included in the first hinge joints 1, the second hinge joints 3, and the third hinge joints 5 have the same structure and the same assembly method for all of them.

The novel rolling annular wedge close-fitting hinge joint 12 includes a pin shaft 121, a nut-washer combination components 122, rolling annular wedges 123, oblique-hole gusset plates 124, and a conversion transfer board 125;

where, the pin shaft 121 is a steel cylinder with standard threads pre-cut at both ends thereof, and the pin shaft 121 connects each of gusset plates linked by the novel rolling annular wedge close-fitting hinge joints 12 in series;

where, the nut-washer combination component 122 includes a nut 122-1, a large diameter washer 122-2, and a small diameter washer 122-3; where, the nut 122-1 is a hexagonal nut with a standard hexagonal threaded hole in the center; where, one side of the large diameter washer 122-2 abuts against a bottom surface of the nut 122-1; where, one side of the small diameter washer 122-3 abuts against a guiding-groove annular wedge 123-1; where, on another side, the large diameter washer 122-2 and the small diameter washer 122-3 abut against each other; where, the large diameter washer 122-2 and the small diameter washer 122-3 are matched, making the transmission of tightening force smoother;

where, the rolling annular wedge 123 includes a guiding-groove annular wedge 123-1, a retaining frame 123-2, and cylindrical rollers 123-3; where, the guiding-groove annular wedge 123-1 has an annular guiding-groove for accommodating the retaining frame 123-2; where, the annular guiding-groove restricts irregular displacement of the cylindrical rollers 123-3; where, a cross-section of the guiding-groove annular wedge 123-1 is in a slotted pedestal wedge shape, and the cross-section in the slotted pedestal wedge shape include a wedge part and a pedestal part; where, the wedge part is in a shape of an elongated triangular pyramid, gradually becoming thicker from a head end to a tail end; where, the pedestal part is trapezoidal and smoothly transitions from a rear end of the wedge part; where, the cylindrical rollers 123-3 comprise several identical steel cylindrical balls; where, the cylindrical rollers 123-3 are set inside the retaining frame 123-2, and the several cylindrical rollers are evenly spaced by the retaining frame 123-2; where, the cylindrical rollers 123-3 are able to rotate within the retaining frame; where, a combination of the cylindrical rollers 123-3 and the retaining frame 123-2 is embedded in the annular guiding-groove; the upper cylindrical roller-retaining frame assembly can roll without resistance in the corresponding annular guiding-groove;

where, the oblique hole gusset plate 124 includes a plate body 124-1 and an oblique-section circle-hole 124-2; where, the plate body 124-1 is an ordinary steel structural panel with a middle part thereof provided with a through circular hole; where, an inner wall of the oblique-section circle-hole 124-2 is an inclined surface, which matches a shape of a sidewall of the guiding-groove annular wedge 123-1;

where, the conversion transfer plate 125 is an ordinary steel structure joint plate which is used for connecting to an oblique-section gusset plate.

The assembly method of the novel rolling annular wedge close-fitting hinge joint is as follows: taking the first hinge joints as an example, the assembly method of the second and third hinge joints is the same as such the example.

The retaining frame 123-2 is embedded into the annular guiding-groove in advance, then the cylindrical rollers 123-3 are embedded into the retaining frame 123-2 with checking one by one whether each cylindrical roller 123-3 can rotate without resistance in the retaining frame, and whether the cylindrical rollers in combination with the retaining frame can roll without resistance in the annular guiding-groove; the pin shaft 121 is passed through the oblique-section circle-hole 124-2 of the first oblique hole gusset plate, and the rolling annular wedge 123 is inserted symmetrically between the pin 121 and the hold wall of the oblique-section circle-hole 124-2. The rolling annular wedge 123 and the pin shaft 121 are designed to achieve line contact, which avoids the stress concentration problem that may be caused when the cylindrical roller 123-3 contacts the pin shaft 121; similarly, the pin shaft 121 is passed through the connecting plate 112 with the oblique holes and the second oblique hole gusset plate 124 in the end gusset plate group 11 in sequence, and then the rolling annular wedge 123 is inserted thereto; if there are more than two oblique hole gusset plates 124, it is to insert the rolling annular wedge 123 according to the above manner; thereafter, it is to tighten the nut-washer combination component 122 to realize the close fitting between the pin shaft 121 in combination with the rolling annular wedge 123 having one end and the gusset plate group 11 in combination with the oblique hole gusset plates 124, so as to comply with the strong constraint requirements of the novel rolling annular wedge close-fitting hinge joint on the relative linear displacement of the rod end; finally, the oblique hole gusset plate 124 and the conversion transfer plate 125 are welded into one body.

EMBODIMENT 2

The following is a second embodiment of the present invention. Different from the previous embodiment, this embodiment provides an assembly method, which includes;

S1: Based on actual engineering application scenarios, determining the exact positions of the first hinge joints 1 at both ends of the novel second-order scissor damper, and welding them to a specific structural component through the end gusset plate groups 11 of the first hinge joints 1.

S2: First, using the first hinge joint 1 on the left as the center of the circle, and using the length of the first-order connecting rod 21 as the radius to make a circle; then using the first hinge joint 1 on the right as the center of the circle, and using the length of the first-order connecting rod 21 as the radius to make a circle; intersecting the two circles to obtain the upper and lower intersection points, which are the positions of the two second hinge joints 3.

After determining the positions of the two first hinge joints 1 and the two second hinge joints 3, the assembly of the first hinge joints 1, the first-order shuttle-shaped linkage mechanical component 2, and the second hinge joints 3 can be completed in sequence. The first hinge joints 1 and the second hinge joints 3 both adopt novel rolling annular wedge close-fitting hinge joints, in which the assembly steps refer to the assembly method of the novel rolling ring wedge close-fitting hinge joint;

S3: The two second hinge joints 3 determined in the second step S2 are the two ends of the internal small movable quadrilateral support frame.

And, first, using the second hinge joint 3 on the top as the center of the circle, and using the length of the small connecting rod 41 as the radius to make a circle; then using the second hinge joint 3 on the bottom as the center of the circle, and using the length of the second-order connecting rod 41 as the radius to make a circle; intersecting the two circles to obtain the left and right intersection points, which are the positions of the two third hinge joints 5.

After determining the positions of the two third hinge joints 5, the assembly of the four small connecting rods 41 of the second-order shuttle-shaped linkage mechanical component and the third hinge joints 5 can be completed in sequence. The two third hinge joints 5 both adopt novel rolling annular wedge close-fitting hinge joints, which is identical with that of the first hinge joints 1 and the second hinge joints 3; the specific steps refer to the performed assembly method of the novel rolling annular wedge close-fitting hinge joint as above;

S4: Installing the viscous damper 6 between the two third hinge points 5 determined in the third step S3.

Since there may be production errors and assembly errors in the second step S2 and the third step S3, there is an error between the actual distance and the theoretical distance between the two third hinge joints 5. Such the error can be eliminated by adjusting the initial position of the piston in the cylinder.

It is important to note that the construction and arrangements of the present application shown in various exemplary embodiments are illustrative only. Although only a few embodiments are described in detail in this disclosure, those reviewing this disclosure will readily appreciate that many modifications are possible without materially departing from the novel teachings and advantages of the subject matter described in this application (e.g. the size, scale, structure, shape and proportion of various components, as well as parameter values (for example, temperature, pressure, etc.), installation arrangement, use of materials, color, orientation changes, etc.). For example, an element shown as integrally formed may be constructed from multiple parts or elements, the position of elements may be inverted or otherwise altered, and the nature or number or position of discrete elements may be altered or varied. Accordingly, all such modifications are intended to be included within the scope of this invention. The order or sequence of any process or method steps may be changed or reordered according to alternative embodiments. In the claim scope, any "means-plus-function" clause is intended to cover the structures described herein as performing the recited function and not only structural equivalents but also equivalent structures. Other substitutions, modifications, changes and omissions may be made in the design, operation and arrangement of the exemplary embodiments without departing from the scope of the invention. Therefore, the present invention is not limited to particular embodiments, but extends to various modifications which still fall within the scope of the appended claims.

Furthermore, in order to provide a concise description of the exemplary embodiments, not all features of an actual implementation are described (i.e., those features which are not relevant to the best mode presently contemplated for carrying out the invention, or which are not relevant to the practice of the invention).

It is understood that numerous implementation-specific decisions may be made during the development of any actual implementation, as in any engineering or design project. Such a development effort might be complex and time consuming, but would be a routine undertaking of design, manufacture and production without undue experimentation to those of ordinary skill having the benefit of this disclosure.

It should be noted that the above embodiments are only used to illustrate the technical solution of the present invention rather than to limit it. Although the present invention has been described in detail with reference to the preferred embodiments, those of ordinary skill in the art will understand that the technical solutions of the present invention can be modified or equivalently substituted without departing from the spirit and scope of the technical solutions of the present invention, which should all be covered by the scope of the claims of the present invention.

What is claimed is:

1. A second-order scissor damper with a configuration and close-fitting joints, comprising:

totally six parts, comprising first hinge joints (1), a first-order shuttle-shaped linkage mechanical component (2), second hinge joints (3), a second-order shuttle-shaped linkage mechanical component (4), third hinge joints (5), and a viscous damper (6);

wherein the second-order shuttle-shaped linkage mechanical component (4) comprises four small connecting rods (41) with equal length and is formed by hinging them together;

wherein the first hinge joint (1) comprises an end gusset plate group (11) and two first rolling annular wedge close-fitting hinge joints (12); wherein, the end gusset plate group (11) comprises two gusset plates (111), a connecting plate (112) with oblique cut holes, and several stiffening ribs (113) which match a shape of sidewalls of the first rolling annular wedge close-fitting hinge joints (12); wherein the two gusset plates (111) are orthogonally welded to form an L-shaped gusset plate group, the connecting plate (112) with the oblique cut holes is hinged with the first rolling annular wedge close-fitting hinge joints (12), the number of the stiffening ribs (113) is four, the connecting plate (112) with the oblique cut holes is provided with four large connecting rods (21), the four large connecting rods (21) with equal length are combined into the first-order shuttle-shaped linkage mechanical component (2), and both ends of each of the four large connecting rods (21) are connected to the first hinge joint (1) and the second hinge joint (3), respectively;

wherein the second hinge joint (3) comprises a first rolling annular wedge mating hinge joint (31) and a second rolling annular wedge mating hinge joint (32), wherein the first rolling annular wedge mating hinge joint (31) is connected to the large connecting rods (21), and the second rolling annular wedge mating hinge joint (32) is connected to the small connecting rods (41);

wherein each of the small connecting rods (41) has both ends s connected to the second hinge joint (3) and the third hinge joint (5), respectively;

wherein the third hinge joint (5) comprises two second rolling annular wedge mating hinge joints (51) and an ear plate (52) connected to the viscous damper (6);

wherein the viscous damper (6) has both ends connected to the third hinge joints (5), respectively.

2. The second-order scissor damper with the configuration and the close-fitting joints according to claim 1, wherein each of the first hinge joints (1), the second hinge joints (3), and the third hinge joints (5) is provided with the first rolling annular wedge close-fitting hinge joints (12) thereon.

3. The second-order scissor damper with the configuration and the close-fitting joints according to claim 2, wherein the first rolling annular wedge close-fitting hinge joint (12) comprises: a pin shaft (121), a nut-washer combination component (122), a rolling annular wedge (123), an oblique-hole gusset plate (124), and a conversion transfer board (125).

4. The second-order scissor damper with the configuration and the close-fitting joints according to claim 3, wherein the pin shaft (121) is a steel cylinder with standard threads pre-cut at both ends thereof, and the pin shaft (121) connects each of gusset plates linked by the first rolling annular wedge close-fitting hinge joints (12) in series.

5. The second-order scissor damper with the configuration and the close-fitting joints according to claim 4, wherein the nut-washer combination component (122) comprises:

a nut (122-1), a large diameter washer (122-2), and a small diameter washer (122-3); wherein the nut (122-1) is a hexagonal nut with a standard hexagonal threaded hole in the center; wherein one side of the large diameter washer (122-2) abuts against a bottom surface of the nut (122-1); wherein one side of the small diameter washer (122-3) abuts against a guiding-groove annular wedge (123-1); wherein, on another side, the large diameter washer (122-2) and the small diameter washer (122-3) abut against each other; wherein the large diameter washer (122-2) and the small diameter washer (122-3) are matched.

6. The second-order scissor damper with the configuration and the close-fitting joints according to claim 5, wherein the rolling annular wedge (123) comprises the guiding-groove annular wedge (123-1), a retaining frame (123-2), and cylindrical rollers (123-3); wherein the guiding-groove annular wedge (123-1) has an annular guiding-groove for accommodating the retaining frame (123-2); wherein the annular guiding-groove restricts irregular displacement of the cylindrical rollers (123-3); wherein a cross-section of the guiding-groove annular wedge (123-1) is in a slotted pedestal wedge shape, and the slotted pedestal wedge shape comprises a wedge part and a pedestal part; wherein the wedge part is in a shape of an elongated triangular pyramid, gradually becoming thicker from a head end to a tail end; wherein the pedestal part is trapezoidal and smoothly transitions from a rear end of the wedge part; wherein the cylindrical rollers (123-3) comprise several identical steel cylindrical balls; wherein the cylindrical rollers (123-3) are set inside the retaining frame (123-2), and the several cylindrical rollers are evenly spaced by the retaining frame (123-2); wherein the cylindrical rollers (123-3) are able to rotate within the retaining frame; wherein a combination of the cylindrical rollers (123-3) and the retaining frame (123-2) is embedded in the annular guiding-groove.

7. The second-order scissor damper with the configuration and the close-fitting joints according to claim 6, wherein the oblique hole gusset plate (124) comprises a plate body (124-1) and an oblique-section circle-hole (124-2); wherein a middle part of the plate body (124-1) is provided with a through hole; wherein an inner wall of the oblique-section circle-hole (124-2) is an inclined surface, which matches a shape of a sidewall of the guiding-groove annular wedge (123-1).

8. The second-order scissor damper with the configuration and the close-fitting joints according to claim 3, wherein the conversion transfer plate (125) is an ordinary steel structure joint plate, and the conversion transfer plate is connected to an oblique-section gusset plate.

* * * * *